US010590755B2

(12) United States Patent
Labrousse

(10) Patent No.: US 10,590,755 B2
(45) Date of Patent: Mar. 17, 2020

(54) CONSTRUCTING SURVEY PROGRAMS IN DRILLING APPLICATIONS

(71) Applicant: Schlumberger Technology Corporation, Sugar Land, TX (US)

(72) Inventor: Sebastien Labrousse, Bergen (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 23 days.

(21) Appl. No.: 15/560,371

(22) PCT Filed: Mar. 23, 2016

(86) PCT No.: PCT/US2016/023751
§ 371 (c)(1),
(2) Date: Sep. 21, 2017

(87) PCT Pub. No.: WO2016/154293
PCT Pub. Date: Sep. 29, 2016

(65) Prior Publication Data

US 2018/0073350 A1 Mar. 15, 2018

Related U.S. Application Data

(60) Provisional application No. 62/136,879, filed on Mar. 23, 2015.

(51) Int. Cl.

| | |
|---|---|
| ***E21B 47/022*** | (2012.01) |
| ***E21B 47/024*** | (2006.01) |
| ***E21B 44/00*** | (2006.01) |
| ***E21B 47/04*** | (2012.01) |

(52) U.S. Cl.
CPC ..... *E21B 47/022* (2013.01); *E21B 44/005* (2013.01); *E21B 47/04* (2013.01)

(58) Field of Classification Search
CPC ..... E21B 47/022; E21B 47/024; E21B 47/04; E21B 47/005; E21B 44/005
See application file for complete search history.

(56) References Cited

U.S. PATENT DOCUMENTS

| | | | |
|---|---|---|---|
| 4,440,020 | A | 4/1984 | Boutemy et al. |
| 6,179,067 | B1 | 1/2001 | Brooks |
| 6,405,808 | B1 | 6/2002 | Edwards et al. |

(Continued)

OTHER PUBLICATIONS

Chia, et al., "A New Wellbore Position Calculation Method," IADC/SPE Asia Pacific Drilling Technology held in Jakarta, Indonesia, Sep. 9-11, 2002.

(Continued)

*Primary Examiner* — Toan M Le
(74) *Attorney, Agent, or Firm* — Alex J. McGinn

(57) ABSTRACT

A computing system, non-transitory computer-readable medium, and a method for surveying a wellbore. The method includes receiving a first survey of the wellbore from a first survey tool, receiving a second survey of the wellbore form a second survey tool, determining a first uncertainty of the first survey tool and a second uncertainty of the second survey tool, determining a first growth rate of the first uncertainty and a second growth rate of the second uncertainty, and generating a combined survey based at least partially on the first and second growth rates.

20 Claims, 6 Drawing Sheets

(56) References Cited

U.S. PATENT DOCUMENTS

| | | | | |
|---|---|---|---|---|
| 2009/0120690 | A1* | 5/2009 | Phillips | E21B 44/00 175/45 |
| 2012/0048618 | A1 | 3/2012 | Zamanian et al. | |
| 2012/0245850 | A1 | 9/2012 | Bang et al. | |

OTHER PUBLICATIONS

Chia, et al., "A New Wellbore Position Calculation Method," Revised manuscript Sep. 2003 SPE Drilling & Completion, pp. 209-213.

Costeno, et al. "Improving Collision Avoidance and Target Accuracy in an Offshore Brownfield Redevelopment Combining Gyros and In-Field Referencing," International Petroleum Technology Conference held in Doha, Qatar, Jan. 20-22, 2014.

Landry, et al., "Improving Well Position Accuracy for More Effective Resource Exploitation," Offshore Technology Conference held in Houston, TX USA Apr. 30-May 3, 2007.

De Lange, et al., "Accurate Surveying: An Operator's Point of View," EADC/SPE Drilling Conference 1988, Dallas, TX Feb. 28-Mar. 2, 1988.

Thorogood, "Directional Survey Operations Management," JPT, Dec. 1989, pp. 1250-1252.

Rasmus, et al., "Techniques for Accurate Geological Correlations in Highly Deviated and Horizontal Wells When Drilling Through Dipping Beds," SPE International Conference on Horizontal Well Technology held in Calgary, Canada Nov. 18-20, 1996, pp. 907-912.

Torkildsen, et al., "Directional Surveying: Rotating and Sliding Operations Give Different Wellbore Position Accuracy," SPE Annual Technical Conference and Exhibition held in Dallas, TX Oct. 1-4, 2000.

Chia, "MWD Survey Accuracy Improvements Using Multistation Analysis," IADC/SPE Asia Pacific Drilling Technology Conference and Exhibition held in Kuala Lumpur, Malaysia, Sep. 13-15, 2004.

Ekseth et al., "The Reliability Problem Related to Directional Survey Data," IADC/SPE Asia Pacific Drilling Technology Conference and Exhibition held in Bangkok, Thailand, Nov. 13-15, 2006.

Ekseth et al., "High Integrity Wellbore Surveys: Methods for Eliminating Gross Errors," SPE/IADC Drilling Conference held in Amsterdam, The Netherlands, Feb. 20-22, 2007.

Landry et al., "Survey Accuracy Extends Well Displacement at Minimum Cost," 15th SPE Middle East Oil & Gas Show and Conference held in Bahrain International Exhibition Centre, Kingdom of Bahrain, Mar. 11-14, 2007.

Okafor, et al., "Well Placement in a Mature California Field," SPE Western Rigional Meeting held in San Jose, California, USA Mar. 24-26, 2009.

Ekseth, et al., "High-Integrity Wellbore Surveying," SPE Drilling & Completion, Dec. 2010, pp. 438-447.

Poedjono, et al., "Case Studies in the Application of Pad Design Drilling in the Marcellus Shale," SPE Eastern Regional Meeting held in Margantown, West Virginia, USA Oct. 12-14, 2010.

Poedjono, et al., "Improved Drilling Economics and Enhanced Target Acquisition through the Application of Effective Geomagnetic Referencing," SPE EUROPEC/EAGE Annual Conference and Exhibition held in Vienna, Austria, May 23-26, 2011.

Bessie, et al., "Integrated Optimization at 8000m in South China Sea," IADC/SPE Asia Pacific Drilling Technology Conference and Exhibition held in Tianjin, China, Jul. 9-11, 2012.

Mat, et al., "The Value of Implementing Survey Management Technique on existing crowded platform to safely drill future wells," SPE/APPEA International Conference on Health, Safety and Environment in Oil and Gas Exploration and Production held in Perth, Australia, Sep. 11-13, 2012.

De Wardt, et al., "Well Bore Collision Avoidance and Interceptions—State of the Art," SPE/IADC Drilling Conference and Exhibition held in Amsterdam, The Netherlands, Mar. 5-7, 2013.

Al-Muhailan, et al., "Directional Challenges and Planning of Relief Well to Resolve an HP/HT Well Blowout," IADC/SPE Drilling Conference and Exhibition held in Fort Worth, TX USA Mar. 4-6, 2014.

International Search Report and Written Opinion for the equivalent International patent application PCT/US2016/023751 dated Jun. 24, 2016.

International Preliminary Report on Patentability for the equivalent International patent application PCT/US2016/023751 dated Oct. 5, 2017.

* cited by examiner

CONSTRUCTING SURVEY PROGRAMS IN DRILLING APPLICATIONS

CROSS-REFERENCE TO RELATED APPLICATIONS

This application claims priority to U.S. Provisional Patent Application Ser. No. 62/136,879, which was filed on Mar. 23, 2015. The entirety of this provisional application is incorporated herein by reference.

BACKGROUND

As a well is drilled, surveys measuring depth, inclination, and azimuth of the well are acquired. The trajectory of the well may be reconstructed based on these surveys. The set of surveys and associated uncertainties provide a "survey program." The different surveys of a survey program may cover the same or overlapping depth intervals. Thus, one task of building the survey program may be to select a survey to use in such intervals. Generally, the uncertainty of the surveys generated by measurements taken by the individual tools is known or determined, and thus the survey measured with the lower or lowest uncertainty at a particular depth may be selected for the survey program.

SUMMARY

Embodiments of the disclosure may provide a method for surveying a wellbore. The method includes receiving a first survey of the wellbore from a first survey tool, receiving a second survey of the wellbore form a second survey tool, determining a first uncertainty of the first survey tool and a second uncertainty of the second survey tool, determining a first growth rate of the first uncertainty and a second growth rate of the second uncertainty, and generating a combined survey based at least partially on the first and second growth rates.

Embodiments of the disclosure may also provide a computing system. The computing system includes one or more processors, and a memory system including one or more non-transitory, computer-readable media storing instructions that, when executed by at least one of the one or more processors, cause the computing device to perform operations. The operations include receiving a first survey of a wellbore from a first survey tool, receiving a second survey of the wellbore form a second survey tool, determining a first uncertainty of the first survey tool and a second uncertainty of the second survey tool, determining a first growth rate of the first uncertainty and a second growth rate of the second uncertainty, and generating a combined survey based at least partially on the first and second growth rates.

Embodiments of the disclosure may further provide a non-transitory, computer-readable medium storing instructions that, when executed by at least one processor of a computing system, cause the computing system to perform operations. The operations include receiving a first survey of a wellbore from a first survey tool, receiving a second survey of the wellbore form a second survey tool, determining a first uncertainty of the first survey tool and a second uncertainty of the second survey tool, determining a first growth rate of the first uncertainty and a second growth rate of the second uncertainty, and generating a combined survey based at least partially on the first and second growth rates.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DESCRIPTION OF EMBODIMENTS

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object, and, similarly, a second object could be termed a first object, without departing from the scope of the invention. The first object and the second object are both objects, respectively, but they are not to be considered the same object.

The terminology used in the description of the invention herein is for the purpose of describing particular embodiments only and is not intended to be limiting of the invention. As used in the description of the invention and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques and workflows that are in accordance with some embodiments. Some operations in the processing procedures, methods, techniques and workflows disclosed herein may be combined and/or the order of some operations may be changed.

Figure 1:
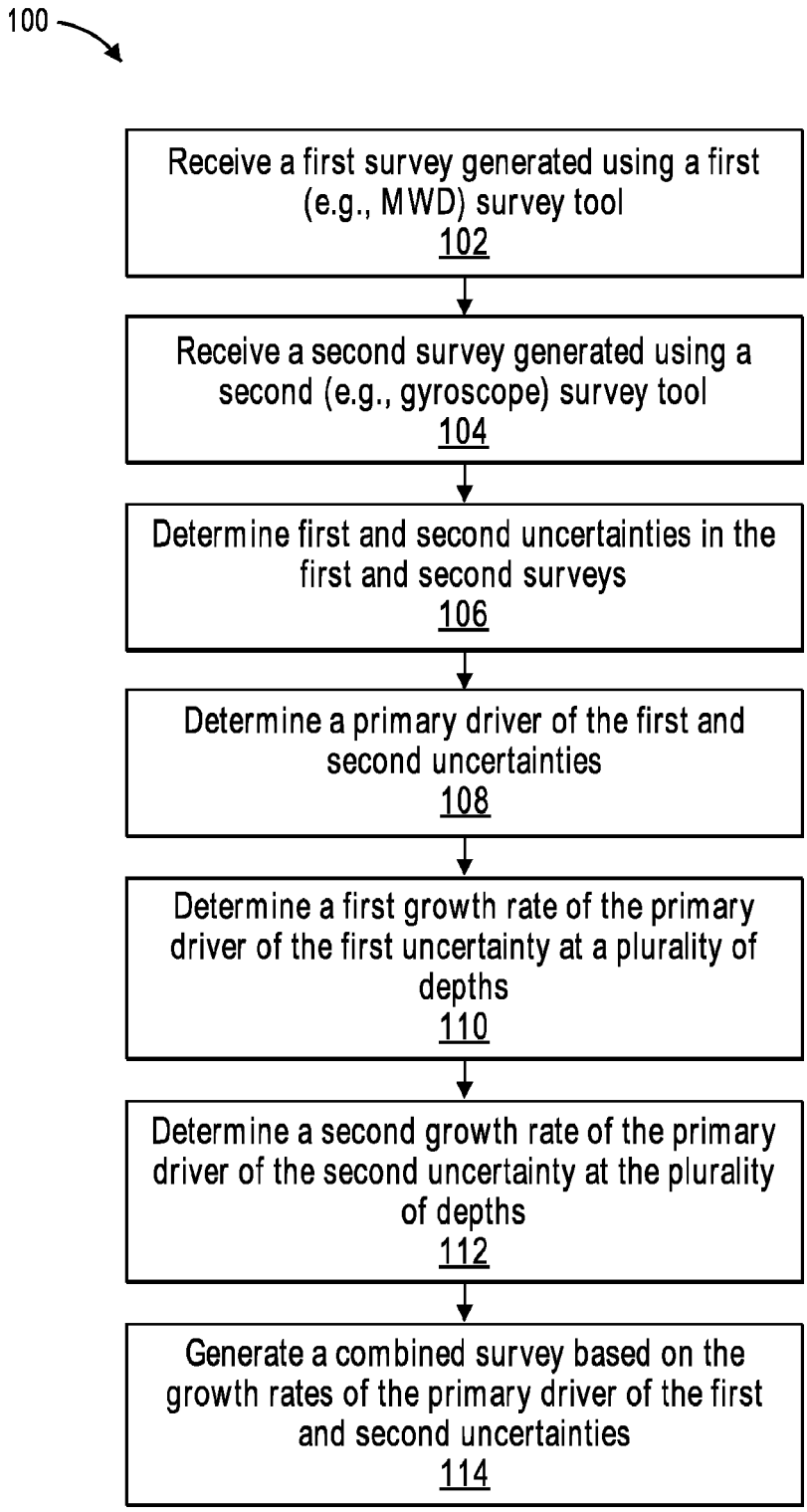
FIG. 1 illustrates a flowchart of a method for surveying a well, according to an embodiment.

FIG. 1 illustrates a flowchart of a method 100 for surveying a wellbore, according to an embodiment. The method 100 may include receiving a first survey generated using a first survey tool in a wellbore, as at 102. The first survey may be, for example, taken using a measurement-while-drilling (MWD) device (e.g., providing the first survey tool), which may be coupled to or form part of a drill string or a bottom-hole assembly.

Figure 2:
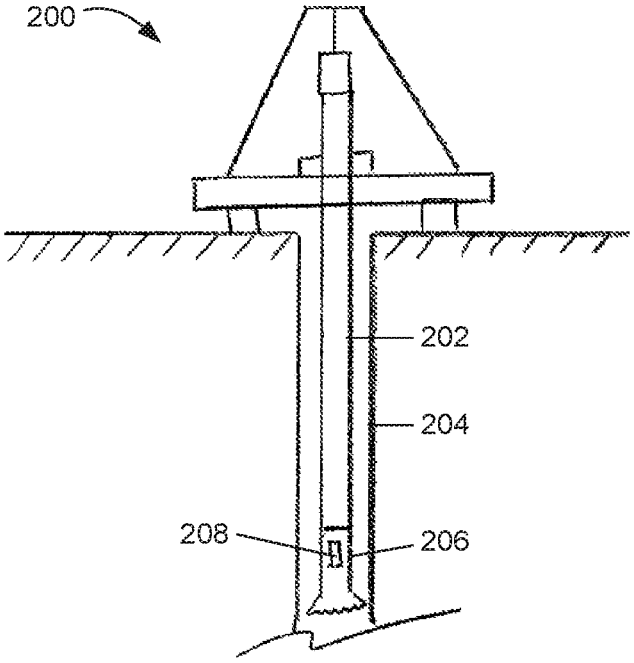
FIG. 2 illustrates a simplified, schematic view of a system for collecting a survey of a well, according to an embodiment.

FIG. 2 illustrates an example of such a survey being taken. As shown, a drilling system 200 is provided, from which a drill string 202 is deployed into a wellbore 204. The drill string 202 includes a bottom-hole assembly 206, which may include a drill bit 208, steering equipment, etc. The bottom-hole assembly 206 may also include an MWD device 208, which may be capable of determining parameters of the wellbore, such as azimuth, inclination, depth, and/or the like, in order to generate the survey from which the well trajectory along its depth may be determined. Thus, the MWD device 208 may provide the first survey tool, in an embodiment.

Figure 3:
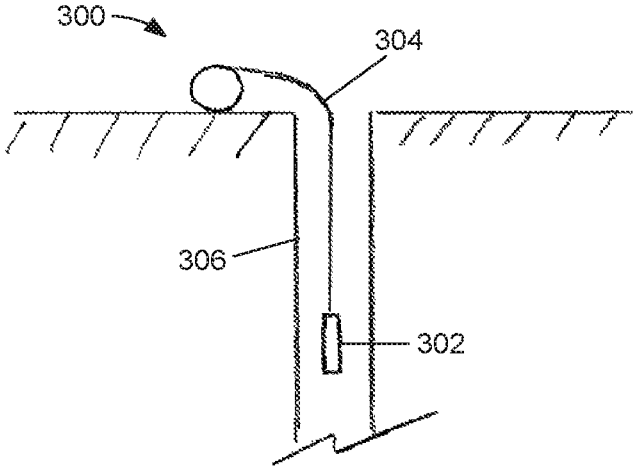
FIG. 3 illustrates a simplified, schematic view of another system for collecting a survey of a well, according to an embodiment.

Referring again to FIG. 1, the method 100 may also include receiving a second survey generated using a second survey tool, as at 104. The second survey tool may, for example, be a gyroscopic instrument, which may be run on a wireline. FIG. 3 illustrates an example of such a survey being taken. As shown in FIG. 3, a wireline system 300 may be provided to deploy a gyro 302 into a wellbore 304 on a wireline 306 (or any other type of rigid, flexible, and/or coiled tubing). The gyro 302 may be configured to take measurements of azimuth, inclination, depth, etc., from which the second survey may be generated.

Turning back to FIG. 1, it will be appreciated that the receiving of blocks 102 and 104 may include receiving, as input, one or more surveys taken as described above (or using other types of survey tools), e.g., prior to the execution of the method 100. In some embodiments, however, receiving at 102 and 104 may also include physically performing the surveys themselves (e.g., running the first and/or second survey tools into the wellbore, etc.).

Having received the first and second surveys, the method 100 may proceed to determining a first uncertainty of the first survey and a second uncertainty of the second survey, as at 106. In particular, the uncertainties of the surveys may be determined along a plurality of depth intervals (or, more concisely, at depths) at which the survey is completed. For example, the position of the well in the three-dimensional space may have some level of uncertainty. The uncertainty may be modeled by a tool error model ("toolcode"). The error model may quantify the uncertainty of the survey measurement. The uncertainty quantified according to the appropriate models may depend on one or more of several factors, including, for example, the type of instrument (gyroscope, MWD, etc.), the wellbore inclination and orientation, the conditions the instrument was run (in drill pipe, in casing, etc.).

The method 100 may then include determining one or more primary drivers of uncertainty in the first and second surveys, as at 108. In general, the primary driver may be selected from semi-major, semi-minor, "highside" uncertainty or "lateral" uncertainty, although other types of uncertainties may be employed. In some embodiments, multiple primary drivers may be identified. The uncertainty of a survey can be described with three components that make up an ellipsoid of uncertainty. The axes may be perpendicular to each other. The ellipsoid may be symmetric across its plane of symmetry and in that plane of symmetry, the largest axis is called the semi-major axis, the smallest is the semi-minor axis. The third axis is the vertical axis. The uncertainty associated with the semi-major axis is the semi-major uncertainty, the uncertainty associated with the semi-minor axis is the semi-minor uncertainty. The uncertainty associated with the vertical axis is the vertical uncertainty. When the ellipsoid of uncertainty is projected onto a plane tangent to the well path at the survey point, the lateral uncertainty is defined as the projection of the semi-major and semi-minor axes to the perpendicular-to-the-well-path direction, and the highside uncertainty is defined as the projection of the vertical uncertainty onto the perpendicular-to-the-well-path vertical component.

The method 100 may also include determining a first growth rate of the first uncertainty, as at 110, and determining a second growth rate of the second uncertainty, as at 112. The first and second growth rates may be determined, for example, by taking a first derivative of the uncertainties determined at 108 for the first and second surveys, respectively.

The method 100 may then include generating a combined survey (a "survey program") based on the first and second growth rates, as at 114. For example, the method 100 at 114 may include comparing the first and second growth rates at the plurality of depths (depth intervals) and selecting the survey at the depth with the lower growth rate. While the method 100 may, in some situations, also consider the uncertainty amount, generally, the selection made during the combining at 114 may consider the growth rate primarily. Accordingly, in some cases, the survey selected at a particular depth may have a higher uncertainty, but a lower uncertainty growth rate. Since the uncertainties of the different surveying tools are uncorrelated (e.g., different measurements by different tools), the depth of the switch according to growth rates from one surveying tool to another, may result in the method 100 avoiding uncertainty jumps, as the error propagates at the lowest rates.

Figure 4:
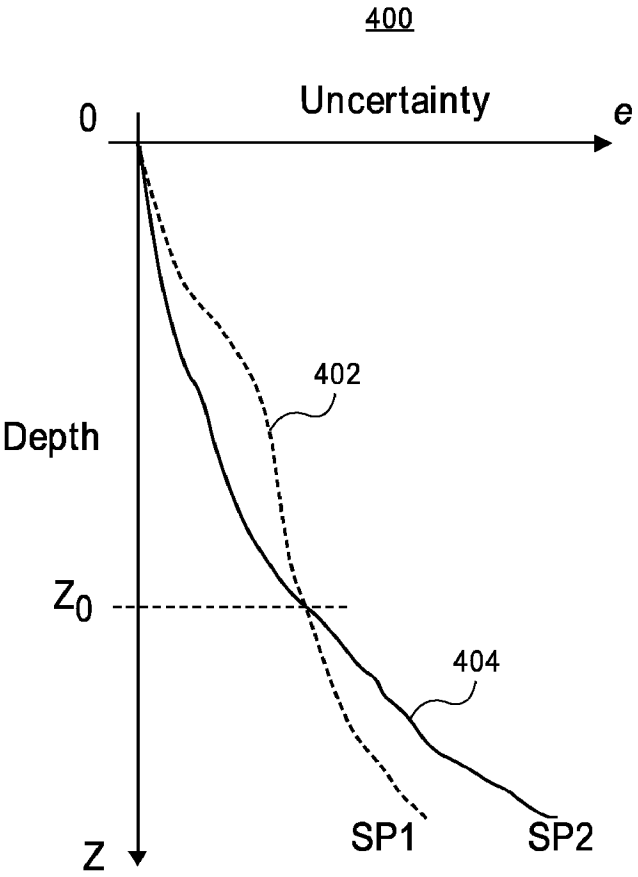
FIG. 4 illustrates a plot of uncertainty as a function of depth for two survey programs, according to an embodiment.

The concepts described above may be further illustrated by way of a non-limiting example, as follows. FIG. 4 illustrates a plot 400 of uncertainty versus depth, with line 402 representing a first survey, and line 404 representing a second survey. In fact, the lines 402, 404 may represent a survey program of one or several survey tools, but for ease of description, the concept is presented herein as if the lines 402, 404 represent a survey taken using a single survey tool.

As shown in FIG. 4, the lines 402, 404 cross at a depth $z_0$. Accordingly, at this point, the survey uncertainty of the second tool, which has less uncertainty in shallower depths, crosses the survey uncertainty of the first tool. However, rather than construct a survey program that uses the second tool from 0 depth to depth $z_0$, the presently disclosed method calculates the rate of growth of the uncertainties (e.g., as at 110 and 112).

Before proceeding to a representative plot of the rate of growth, it is noted that actual well paths are constructed from a set of discrete surveys, and thus derivatives are generally approximations. An interpolation factor δ may be used. The interpolation factor δ may be the distance between any two survey points. For numerical modeling, this can be reduced to a value that facilitates computing. The first order derivative of uncertainty e and depth z may thus be approximated as:

$$\frac{de}{dz}(z) = \frac{e(z+\delta) - e(z)}{\delta}$$

Figure 5:
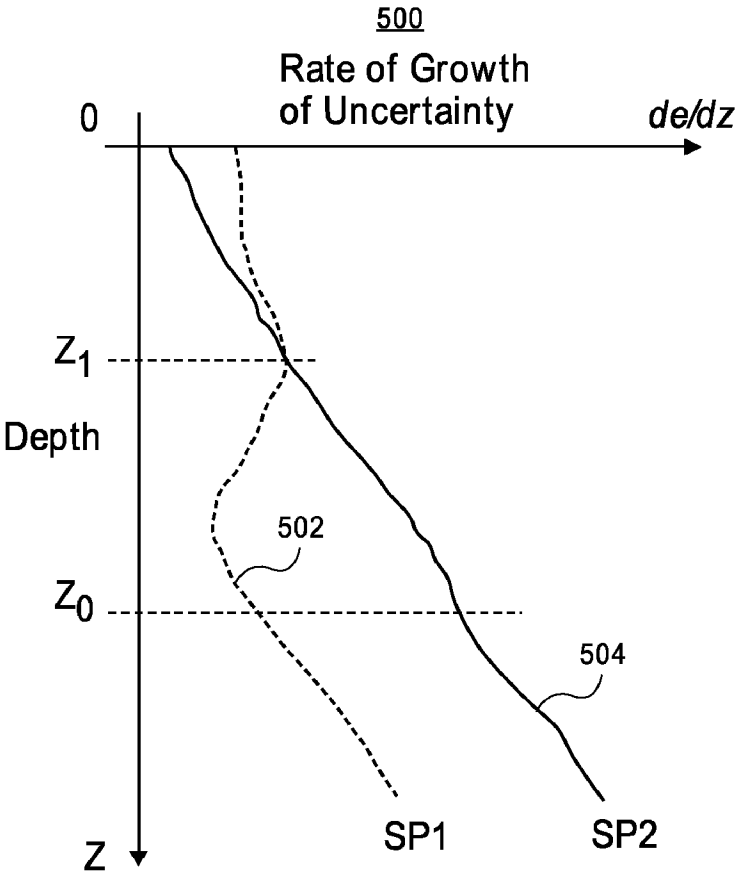
FIG. 5 illustrates a plot of a growth rate of uncertainty as a function of depth for the two survey programs, according to an embodiment.

FIG. 5 illustrates a plot 500 of the rates of growth for the first survey tool, line 502, and the second survey tool, line 504. As shown, the lines 502, 504 cross at depth $z_2$, which is shallower than the depth $z_0$. In accordance with the present method, the combined survey (survey program) includes the second tool's survey from depth 0 to depth $z_2$, and then switches to the survey taken by the first tool.

Figure 6:
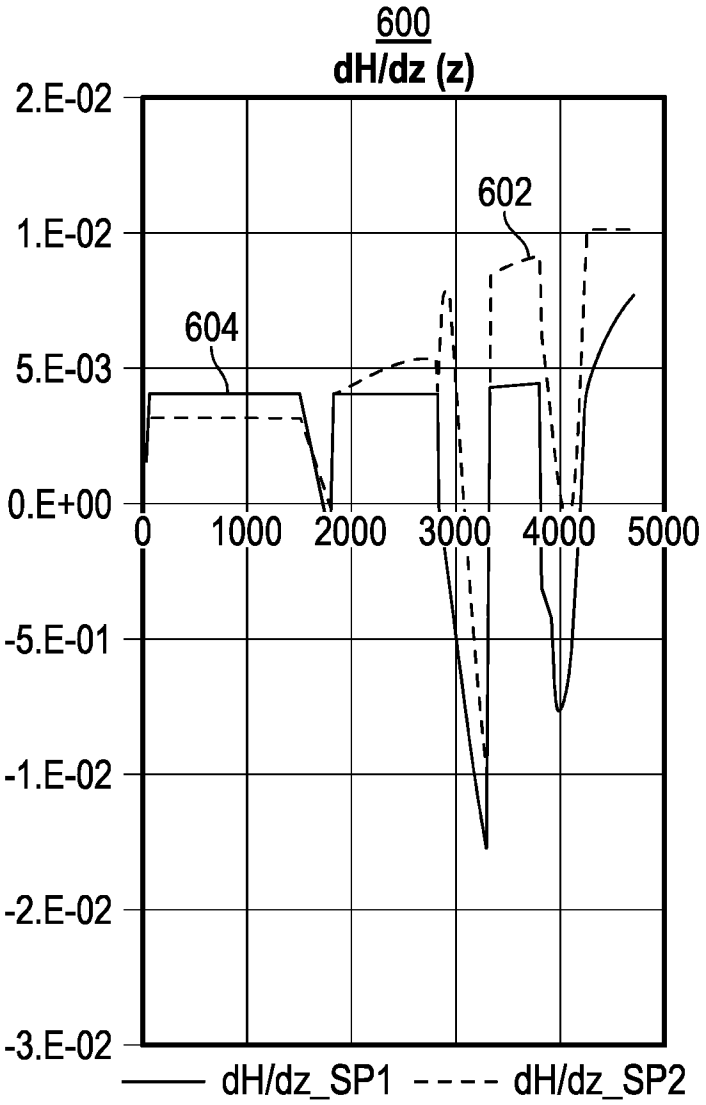
FIG. 6 illustrates a plot of a growth rate of highside uncertainty as a function of depth, according to an embodiment.
Figure 7:
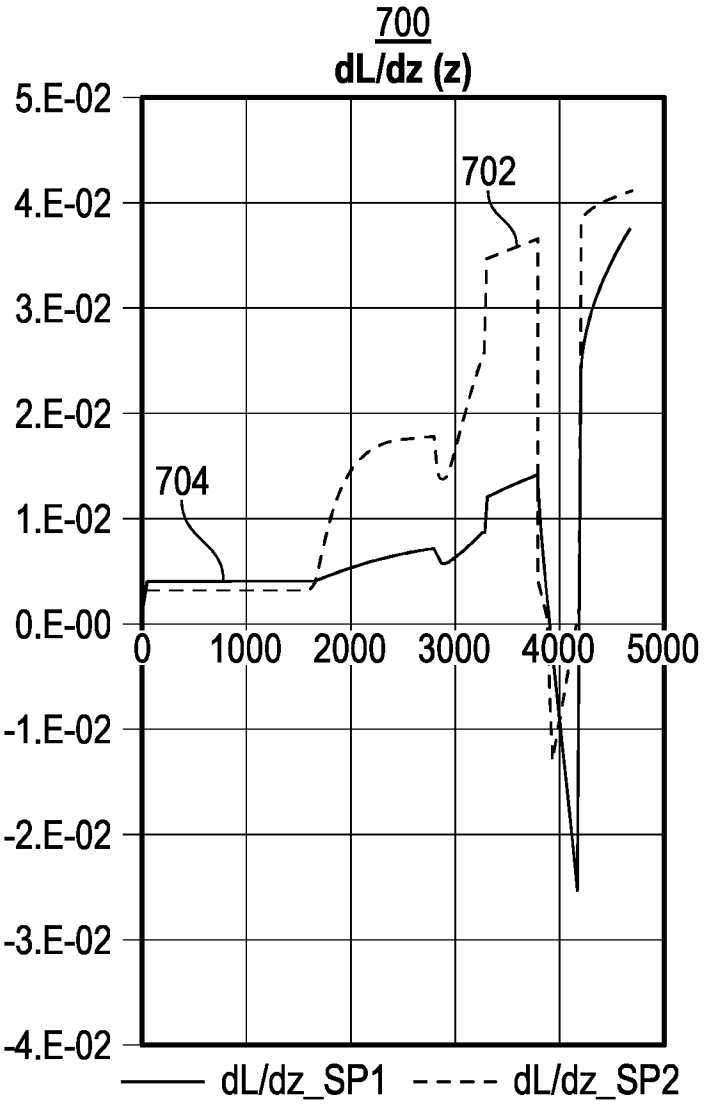
FIG. 7 illustrates a plot of a growth rate of lateral uncertainty as a function of depth, according to an embodiment.

Referring now to FIGS. 6 and 7, a plot 600 of highside uncertainty growth rate and a plot 700 of lateral uncertainty growth rate are illustrated, respectively. Referring to the magnitude of the growth rates (vertical axes), it can be seen that the growth rate of the lateral uncertainty (FIG. 7) is about an order of magnitude greater than the growth rates of the highside uncertainty (FIG. 6), and thus the growth rate of the lateral uncertainty may be considered the primary driver of the overall growth rate of uncertainty; accordingly, the presently disclosed method may, in this example, be focused on selecting the lower growth rate of lateral uncertainty.

Figure 8:
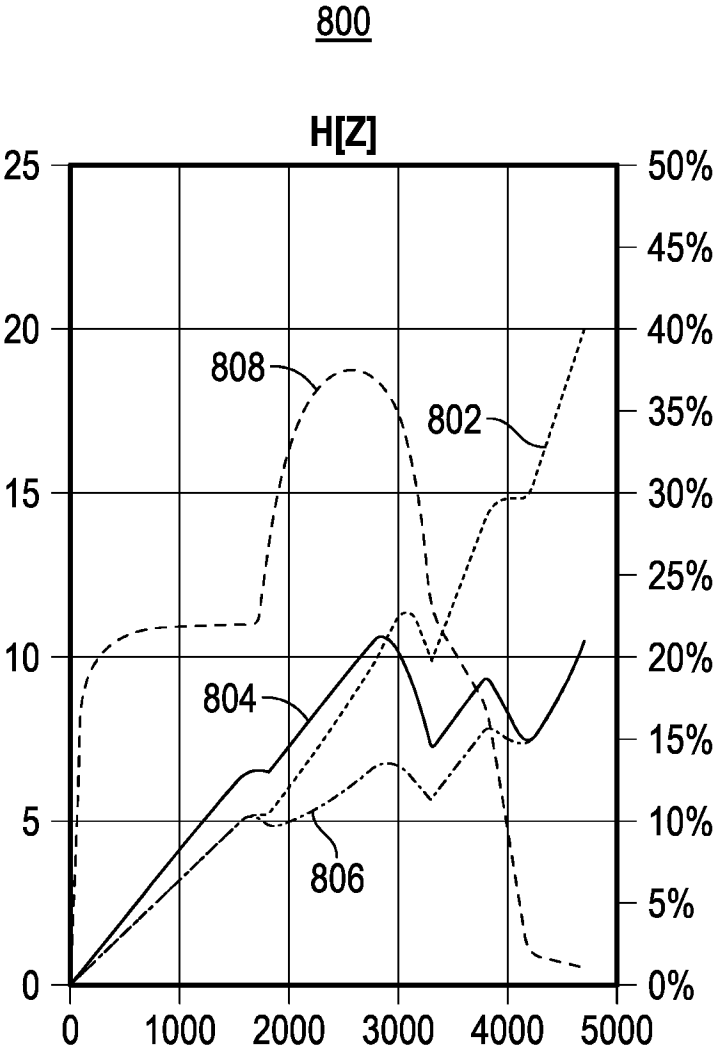
FIG. 8 illustrates a plot of highside uncertainty as a function of depth, according to an embodiment.
Figure 9:
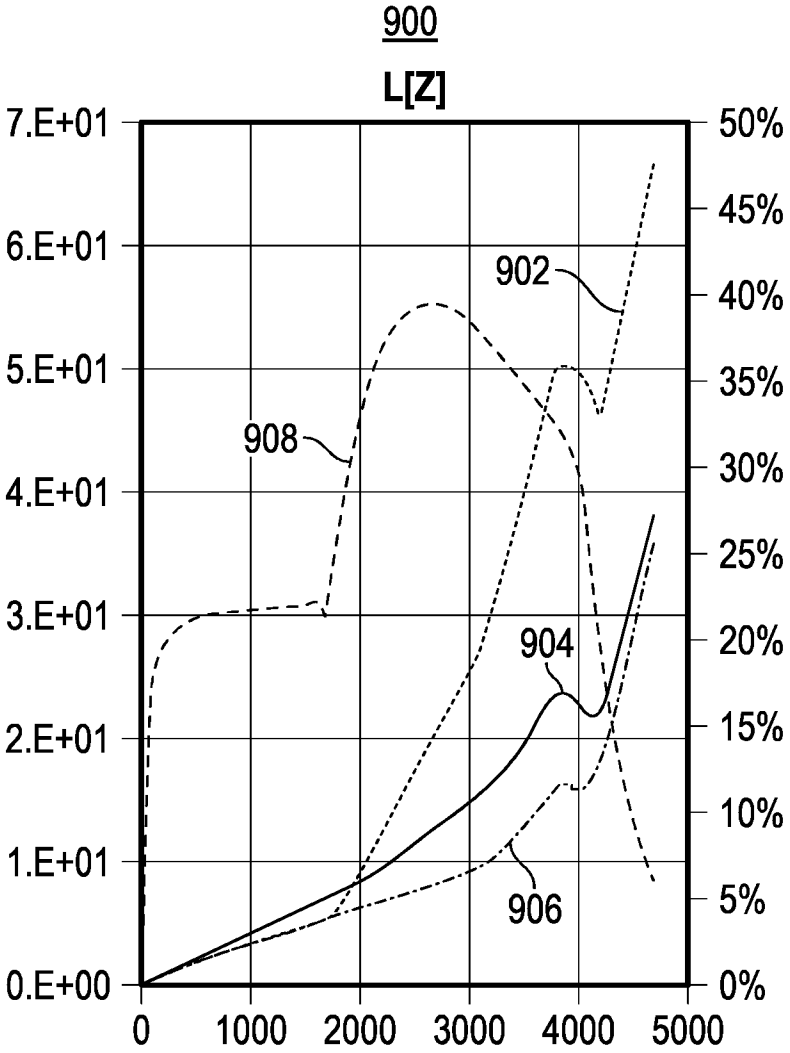
FIG. 9 illustrates a plot of lateral uncertainty as a function of depth, according to an embodiment.

FIGS. 8 and 9 illustrate a plot 800 of highside uncertainty and a plot 900 of lateral uncertainty, both as a function of depth z, respectively, according to an embodiment. In particular, lines 802 and 902 illustrate the resultant uncertainty when the presently-disclosed method is employed to select the surveys at the depths. Lines 804 and 806 illustrate the highside uncertainty of the first and second tools, respectively, and lines 904, 906 illustrate the lateral uncertainty of the first and second tools, respectively. Further, lines 808 and 908 illustrate the reduction, in percentage, of the uncertainty between the lateral and highside uncertainties, respectively, when the present method is employed versus the uncertainty inherent in each of the surveys. As can be seen, the lateral uncertainty is reduced by as much as about 40% in this example, without limitation.

Accordingly, the presently disclosed method improves survey programs by combining surveys taken by different survey tools. The combination is based on the rate of propagation of uncertainties and the decorrelation of surveying tools. Rates of propagation of uncertainties are calculated with the first order derivatives of uncertainty with respect to depth, and the surveying tool with the smallest derivative at each depth may be selected for inclusion in the final survey program. Further, some embodiments of the present method may assist operators in determining which depth intervals may be omitted from surveying with certain tools (e.g., if, based on the tool code, it is apparent that a survey taken by an MWD tool will be employed rather than a gyro survey tool, the gyro survey tool may skip that interval).

In one or more embodiments, the functions described can be implemented in hardware, software, firmware, or any combination thereof. For a software implementation, the techniques described herein can be implemented with modules (e.g., procedures, functions, subprograms, programs, routines, subroutines, modules, software packages, classes, and so on) that perform the functions described herein. A module can be coupled to another module or a hardware circuit by passing and/or receiving information, data, arguments, parameters, or memory contents. Information, arguments, parameters, data, or the like can be passed, forwarded, or transmitted using any suitable means including memory sharing, message passing, token passing, network transmission, and the like. The software codes can be stored in memory units and executed by processors. The memory unit can be implemented within the processor or external to the processor, in which case it can be communicatively coupled to the processor via various means as is known in the art.

Figure 10:
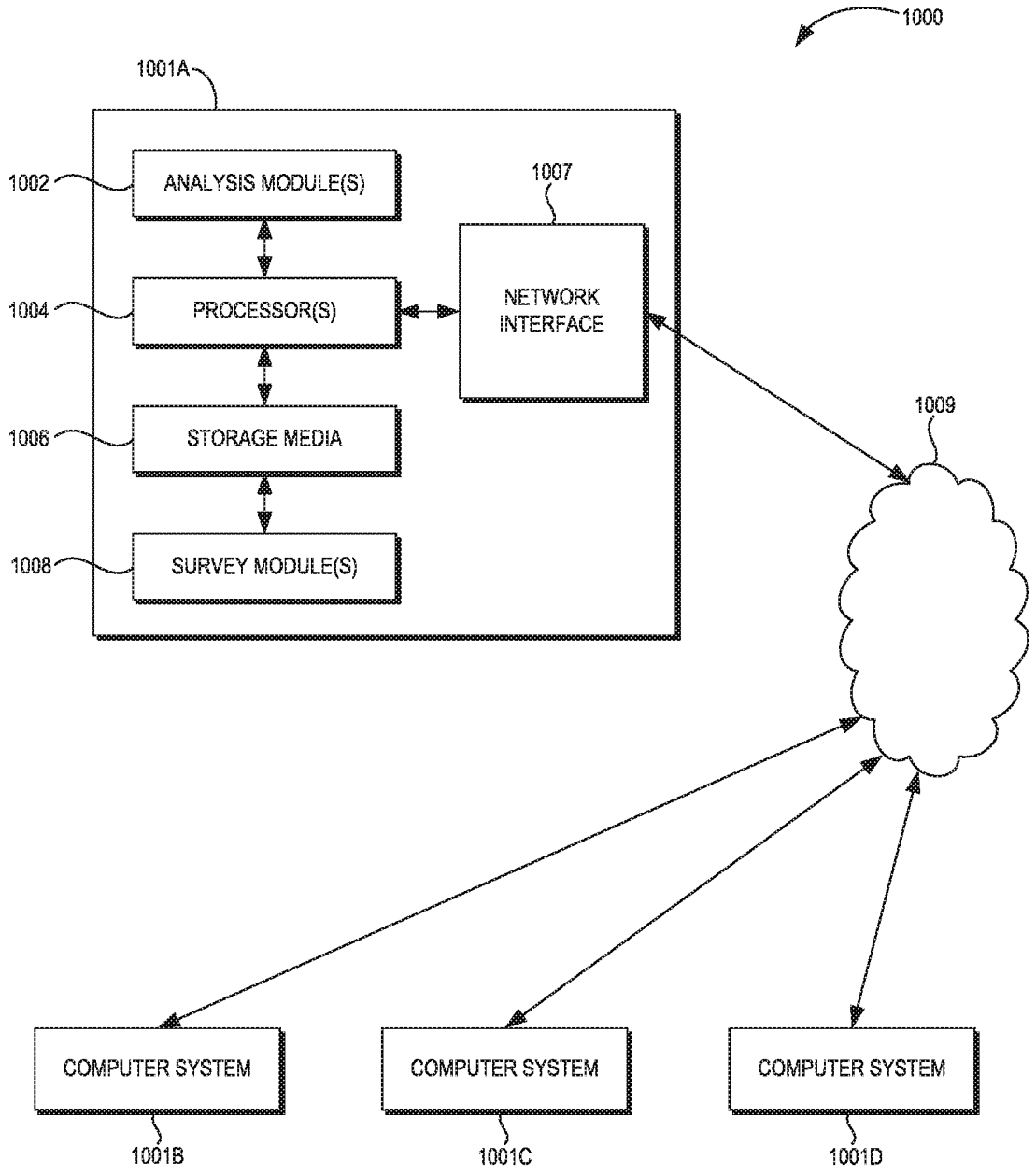
FIG. 10 illustrates a schematic view of a computing system, according to an embodiment.

In some embodiments, any of the methods of the present disclosure may be executed by a computing system. FIG. 10 illustrates an example of such a computing system 1000, in accordance with some embodiments. The computing system 1000 may include a computer or computer system 1001A, which may be an individual computer system 1001A or an arrangement of distributed computer systems. The computer system 1001A includes one or more analysis module(s) 1002 configured to perform various tasks according to some embodiments, such as one or more methods disclosed herein. To perform these various tasks, the analysis module 1002 executes independently, or in coordination with, one or more processors 1004, which is (or are) connected to one or more storage media 1006. The processor(s) 1004 is (or are) also connected to a network interface 1007 to allow the computer system 1001A to communicate over a data network 1009 with one or more additional computer systems and/or computing systems, such as 1001B, 1001C, and/or 1001D (note that computer systems 1001B, 1001C and/or 1001D may or may not share the same architecture as computer system 1001A, and may be located in different physical locations, e.g., computer systems 1001A and 1001B may be located in a processing facility, while in communication with one or more computer systems such as 1001C and/or 1001D that are located in one or more data centers, and/or located in varying countries on different continents).

A processor can include a microprocessor, microcontroller, processor module or subsystem, programmable integrated circuit, programmable gate array, or another control or computing device.

The storage media 1006 can be implemented as one or more computer-readable or machine-readable storage media. Note that while in the example embodiment of FIG. 10 storage media 1006 is depicted as within computer system 1001A, in some embodiments, storage media 1006 may be distributed within and/or across multiple internal and/or external enclosures of computing system 1001A and/or additional computing systems. Storage media 1006 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLU-RAY® disks, or other types of optical storage, or other types of storage devices. Note that the instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

In some embodiments, computing system 1000 contains one or more survey module(s) 1008. In the example of computing system 1000, computer system 1001A includes the survey module 1008. In some embodiments, a single survey module may be used to perform at least some aspects of one or more embodiments of the methods. In other embodiments, a plurality of survey modules may be used to perform at least some aspects of methods.

It should be appreciated that computing system 1000 is only one example of a computing system, and that computing system 1000 may have more or fewer components than shown, may combine additional components not depicted in the example embodiment of FIG. 10, and/or computing system 1000 may have a different configuration or arrangement of the components depicted in FIG. 10. The various components shown in FIG. 10 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of protection of the invention.

Geologic interpretations, models and/or other interpretation aids may be refined in an iterative fashion; this concept is applicable to embodiments of the present methods discussed herein. This can include use of feedback loops executed on an algorithmic basis, such as at a computing device (e.g., computing system 1000, FIG. 10), and/or through manual control by a user who may make determinations regarding whether a given step, action, template, model, or set of curves has become sufficiently accurate for the evaluation of the subsurface three-dimensional geologic formation under consideration.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods are illustrated and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. A method for surveying a wellbore to generate an improved survey of the wellbore, comprising:

receiving a first survey of the wellbore from a first survey tool that utilizes a first, sensor-based technique to determine a first series of survey measurements with respect to depth for a depth range of the wellbore;

receiving a second survey of the wellbore from a second survey tool that utilizes a second, different sensor-based technique to determine a second series of survey measurements with respect to depth for the depth range of the wellbore;

determining, for the depth range of the wellbore, a first uncertainty of the first survey tool in making the first series of survey measurements and a second uncertainty of the second survey tool in making the second series of survey measurements;

determining a first growth rate of the first uncertainty with respect to depth of the depth range of the wellbore and a second growth rate of the second uncertainty with respect to depth of the depth range of the wellbore; and generating the improved survey of the wellbore by using a combination of the first and second growth rates to determine, for the depth range of the wellbore, that, where the first growth rate is lower than the second growth rate, the improved survey of the wellbore includes a portion of the first series of survey measurements and that, where the second growth rate is lower than the first growth rate, the improved survey of the wellbore includes a portion of the second series of survey measurements.

2. The method of claim 1, wherein the first uncertainty is greater than the second uncertainty for at least one of a plurality of depths of the depth range, wherein the first growth rate is less than the second growth rate at the at least one of the plurality of depths of the depth range, such that the combined survey includes the first uncertainty at the at least one of the plurality of depths.

3. The method of claim 1, further comprising determining a primary driver to the first uncertainty and the second uncertainty.

4. The method of claim 3, further comprising determining the first growth rate and the second growth rate based on the primary driver of the first and second uncertainties.

5. The method of claim 4, wherein the primary driver comprises at least one of lateral uncertainty, highside uncertainty, semi-major uncertainty, or semi-minor uncertainty.

6. The method of claim 1, wherein the first survey tool comprises a measurement-while-drilling device, and wherein the second survey tool comprises a gyroscope.

7. The method of claim 1 wherein the depth comprises measured depth.

8. A computing system, comprising:

one or more processor; and a memory system comprising one or more non-transitory, computer-readable media storing instructions that, when executed by at least one of the one or more processors, cause the computing system to perform operations, the operations comprising:

receiving a first survey of a wellbore from a first survey tool that utilizes a first, sensor-based technique to determine a first series of survey measurements with respect to depth for a depth range of the wellbore;

receiving a second survey of the wellbore from a second survey tool that utilizes a second, different sensor-based technique to determine a second series of survey measurements with respect to depth for the depth range of the wellbore;

determining, for the depth range of the wellbore, a first uncertainty of the first survey tool in making the first series of survey measurements and a second uncertainty of the second survey tool in making the second series of survey measurements;

determining a first growth rate of the first uncertainty with respect to depth of the depth range of the wellbore and a second growth rate of the second uncertainty with respect to depth of the depth range of the wellbore; and generating an improved survey of the wellbore by using a combination of the first and second growth rates to determine, for the depth range of the wellbore, that, where the first growth rate is lower than the second growth rate, the improved survey of the wellbore includes a portion of the first series of survey measurements and that, where the second growth rate is lower than the first growth rate, the improved survey of the wellbore includes a portion of the second series of survey measurements.

9. The system of claim 8, wherein the first uncertainty is greater than the second uncertainty for at least one of a plurality of depths of the depth range, wherein the first growth rate is less than the second growth rate at the at least one of the plurality of depths of the depth range, such that the combined survey includes the first uncertainty at the at least one of the plurality of depths.

10. The system of claim 8, wherein the operations further comprise determining a primary driver to the first uncertainty and the second uncertainty.

11. The system of claim 10, wherein the operations further comprise determining the first growth rate and the second growth rate based on the primary driver of the first and second uncertainties.

12. The system of claim 11, wherein the primary driver comprises at least one of lateral uncertainty, highside uncertainty, semi-major uncertainty, or semi-minor uncertainty.

13. The system of claim 8, wherein the first survey tool comprises a measurement-while-drilling device, and wherein the second survey tool comprises a gyroscope.

14. The computing system of claim 8 wherein the depth comprises measured depth.

15. A non-transitory, computer-readable medium storing instructions that, when executed by at least one processor of a computing system, cause the computing system to perform operations, the operations comprising:

receiving a first survey of a wellbore from a first survey tool that utilizes a first, sensor-based technique to determine a first series of survey measurements with respect to depth for a depth range of the wellbore;

receiving a second survey of the wellbore from a second survey tool that utilizes a second, different sensor-based technique to determine a second series of survey measurements with respect to depth for the depth range of the wellbore;

determining, for the depth range of the wellbore, a first uncertainty of the first survey tool in making the first series of survey measurements and a second uncertainty of the second survey tool in making the second series of survey measurements;

determining a first growth rate of the first uncertainty with respect to depth of the depth range of the wellbore and a second growth rate of the second uncertainty with respect to depth of the depth range of the wellbore; and generating an improved survey of the wellbore by using a combination of the first and second growth rates to determine, for the depth range of the wellbore, that, where the first growth rate is lower than the second growth rate, the improved survey of the wellbore includes a portion of the first series of survey measurements and that, where the second growth rate is lower than the first growth rate, the improved survey of the wellbore includes a portion of the second series of survey measurements.

16. The medium of claim 15, wherein the first uncertainty is greater than the second uncertainty for at least one of a plurality of depths of the depth range, wherein the first growth rate is less than the second growth rate at the at least one of the plurality of depths of the depth range, such that the combined survey includes the first uncertainty at the at least one of the plurality of depths.

17. The medium of claim 15, wherein the operations further comprise: determining a primary driver to the first uncertainty and the second uncertainty; and determining the first growth rate and the second growth rate based on the primary driver of the first and second uncertainties.

18. The medium of claim 17, wherein the primary driver comprises at least one of lateral uncertainty, highside uncertainty, semi-major uncertainty, or semi-minor uncertainty.

19. The medium of claim 15, wherein the first survey tool comprises a measurement-while-drilling device, and wherein the second survey tool comprises a gyroscope.

20. The medium of claim 15 wherein the depth comprises measured depth.

* * * * *